United States Patent [19]

Fishburn

[11] Patent Number: 4,706,432

[45] Date of Patent: Nov. 17, 1987

[54] AIR VAPOR SECUREMENT CLOSURE FOR A MEMBRANE ROOFING SYSTEM

[75] Inventor: Douglas C. Fishburn, Hornby, Canada

[73] Assignee: Fishburn Roofing Sciences Group Limited, Hornby, Canada

[21] Appl. No.: 830,353

[22] Filed: Feb. 18, 1986

[51] Int. Cl.[4] ..... E04D 1/28

[52] U.S. Cl. ..... 52/404; 52/410; 52/544

[58] Field of Search ..... 52/408–410, 52/404, 393, 395, 90, 22, 544

[56] References Cited

U.S. PATENT DOCUMENTS 3,408,786 11/1968 Snyker ..... 52/544 X
4,038,804 8/1977 Haage et al. ..... 52/544 X
4,233,791 11/1980 Kuhl et al. ..... 52/410 X
4,346,541 8/1982 Schmitt ..... 52/544 X
4,528,789 7/1985 Simpson ..... 52/410 X
4,557,081 12/1985 Kelly ..... 52/408

*Primary Examiner*—Carl D. Friedman
*Assistant Examiner*—Richard E. Chilcot, Jr.
*Attorney, Agent, or Firm*—Ridout & Maybee

[57] ABSTRACT

A composite roofing system having a layer of insulation and a roof membrane is provided with an air seal structure about the insulation layer. The air seal preferably also coacts with a vapor barrier and is fastened to the roof deck and sealed to the roof membrane. The resulting roof system is independent of the flashing structure for the roof and incorporates the roofing system into the air seal for the entire building.

19 Claims, 3 Drawing Figures

AIR VAPOR SECUREMENT CLOSURE FOR A MEMBRANE ROOFING SYSTEM

The present invention relates to an improved roofing system. In particular, the invention provides a roof structure having a sealed perimeter independent of the vertical flashings thereby resulting in more stable roof and flashing structures.

Associated with the construction of a flat composite roof for a building, a major concern is to ensure that water or moisture vapor does not penetrate the roof structure. It is also important that the roof structure remains in place and is able to resist wind or thermally induced movement. To provide the primary waterproofing for the roof, conventional practice has been to apply felt membranes, usually in several layers interspersed with layers of bitumen. More recently, membranes of polyvinylchloride (PVC) or HYPALON (trade mark) plastic, or EPDM rubber (ethylene-propylene terpolymer), or sheet applied modified asphalt have been used in a single layer to serve as the principal means of waterproofing for the roof. HYPALON is an elastomer comprising chloro and sulfonylchloro substituted polyethylene.

The waterproofing membrane is applied to the roof from a roll or in sheets of material, and the membrane is usually extended vertically at the roof perimeter to overlap with the vertical flashing system, thereby providing a water seal about the edges formed by the horizontal and vertical surfaces. Thus, the vertical flashings are structurally connected to the horizontal composite roof system. With the rise in energy cost, the need to provide a more thermally efficient roofing system has increased in importance. Coupled with this factor is the growing concern for providing an air sealed building, and hence, the need to integrate an air sealed structure for the roofing system into the total air seal for the building. In modern buildings having a forced air heating and cooling system, the air is pressurized relative to the external atmosphere. When considered from the reference of the roof, the building represents a column of pressurized air which can escape through terminal points of the roof, especially at the eaves thereof, and which in the case of a loose laid roof membrane, may travel under the membrane causing condensation of moisture.

Thermally induced movement of the roofing structure may cause structural components to become displaced, resulting in damage to roof components and roof failure. For example, the roof and flashing membranes are sealed together at the roof perimeter. Since the roof is exposed to the environment, heating and cooling of the roof causes the horizontal roof structure to expand and contract. This movement may in turn cause the roof membrane to pull the flashing membrane, to which it is attached, away from its vertical surface. Other roofing components may also be damaged from movement of the roof structure in response to thermal or wind forces which can lead to premature failure of the roof. Thus, stability of the roofing system is important to ensure the proper performance of the roof.

Similarly, in loose laid or mechanically attached roofs, or roofs having unballasted or unprotected membranes, pressure differences across the membrane often results in billowing. This billowing of the membrane may be especially pronounced under windy conditions. Billowing of the membrane provides a pumping action with respect to the air within the building encouraging ingression of moisture laden air beneath the membrane with its accompanying problems. Clearly, damage to the membrane itself may result from this billowing effect.

A number of practical problems are associated with the manufacture and performance of a conventional roof system. In constructing a roof having a horizontal surface and various vertical surfaces, the contractor is faced with employing the skills of a number of different trade workers. Carpenters are needed to install wood blocking used to secure flashing and roofing components, masonry workers are needed to deal with installation of structures in cement or brick walls, and roofers are needed to install the roof itself. It is often difficult to coordinate the timing of the roof construction with the availability of trade workers since construction delays are often encountered due to poor weather conditions. Thus, partially completed roofs are more often than not subjected to wet weather conditions giving rise to the possibility of water seepage beneath the membrane of the partial structure.

Water or moisture vapor may enter a finished roof structure from above or below. Thermal forces on the flashing and roof structures may cause cracks to develop at the areas where the horizontal and vertical surfaces meet. Cracks or openings in the roof deck may allow moisture from the building to enter the roof structure and cause deterioration thereof. The problem is further complicated by the fact that moisture once in the roof structure usually travels beneath the membrane. In sufficient quantity such moisture may condense and cause damage to the insulation layer or other building components. Thus, roof damage may occur in an area of the roof remote from the site of the structural failure making repair difficult.

A thermal bridge exists across a roof structure allowing a heat transfer between the exterior environment and the inside of the building. Depending on the type of roof construction, this thermal bridging may be pronounced or minimal. The present invention minimizes the thermal bridge effect when compared with other roof structures.

The present invention also allows the roof structure to be subdivided into a plurality of roof sections. Each such section is stabilized and secured in place by virtue of the invention which provides a mechanical securing of the roof against uplifting forces.

The present invention addresses these and other problems associated with a composite roof system by providing a closure at the junction of the roof with all vertical flashing members and allows the flashing and roof system to act separately or in unison to protect the roof from moisture ingression. The invention allows the horizontal roof structure to be independent of the vertical flashing structures and may provide a plurality of modular horizontal roof structures distinct from one another which form a unitary roofing system. The invention is intended to be used in association with an insulated roofing system and comprises a rigid air seal member extending beneath the horizontal roof structure. The rigid member is fastened to the roof deck and preferably sealed to a vapor barrier for the structure, the rigid member also preferably extending upwardly along an upright peripheral surface of the roof structure. A membrane air seal member extends over the roof structure and is sealed to the horizontal roof membrane. The air seal membrane also extends downward along the upright peripheral surface and is fastened to the rigid member thereby providing a closure about the periphery of the horizontal roof structure.

A more complete understanding of the invention may be obtained from the following description with reference being made to the drawings in which.

Figure 1:
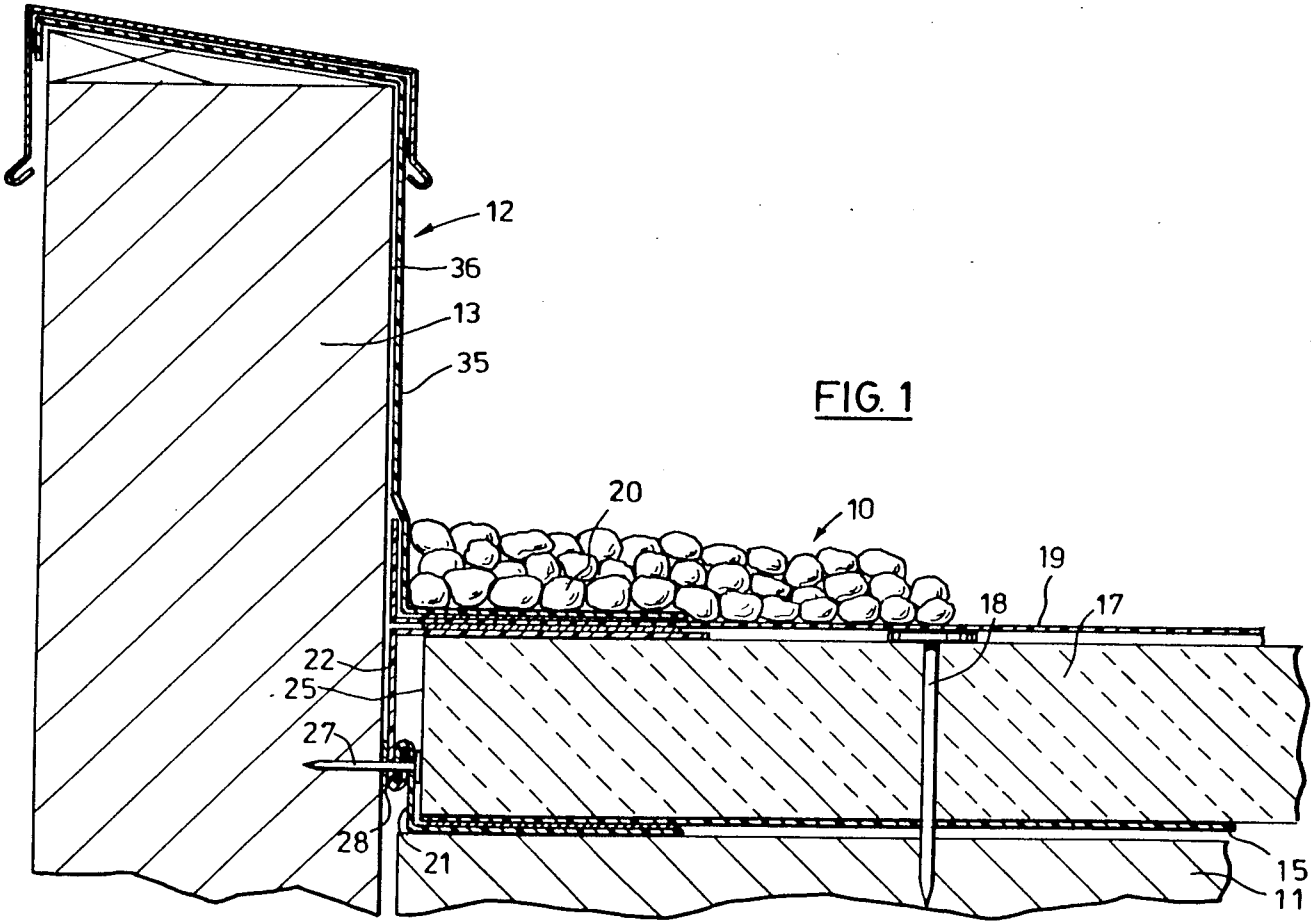
FIG. 1 is a cross sectional view of a roof structure at a parapet wall having a vertical flashing structure.

Referring to FIG. 1, a common roofing installation comprises a horizontal roof structure 10 for a roof deck 11 and a vertical flashing structure 12 associated with a parapet wall 13. The horizontal roof structure 10 preferably includes a vapor barrier 15 located adjacent the deck 11. An insulation layer 17 and a roof membrane 19 overlying the insulation 17 are basic components of the roof structure 10, and may comprise any of a wide variety of materials readily available in the marketplace and well known to the person skilled in this art. A layer of aggregate 20 is preferably applied over the membrane 19 to provide protection to the membrane 19 and to act as a ballast to hold it down in place. Ballast aggregate 20 is not required in a totally mechanically attached roof system.

The vapor barrier 15 may be any of a number of standard plastic or composite paper sheet products well known in the art and is used to prevent air leakage from the building damaging the insulation layer. Clearly, this leakage may be suppressed in other ways, such as providing a cement deck with a coating of a suitable sealer. Seams between sheets of vapor barrier 15 are sealed together in overlapping fashion with an appropriate sealant adhesive. The insulation layer 17 may be fastened to the deck 11 by fasteners 18 or an adhesive. The insulation 17 may be any of a wide variety of materials depending on the particular application. Examples of insulation 17 include but are not limited to wood fibre board, glass fibre, urethane expanded or extruded polystyrene foam, cork, phenolic foam, perlite, cellular glass or other similar materials.

The roof membrane 19 may be any conventional roof membrane but is preferably PVC or HYPALON plastic, or EPDM rubber, or sheet applied modified asphalt. The roof membrane 19 may be protected from physical damage by the application of a top dressing for the roof such as a layer of aggregate 20.

The present invention as shown in FIG. 1 provides a modification of this basic horizontal roof structure 10 by employing lower and upper air seal members 21 and 22 to seal the perimeter of the roof structure 10 thereby making the structure 10 independent of the vertical flashing structure 12.

The lower air seal member 21 is preferably sheet metal but may be any suitable rigid material. The member 21 extends beneath the roof structure 10 and is mechanically fastened to the deck 11 and is adhesively sealed to the vapor barrier 15. A portion of the lower member 21 preferably extends upwardly along the upright surface 25 of the roof structure 10 at the insulation layer 17 where it engages and is fastened to the upper air seal member 22. There may be applications where it is preferable not to extend the member 21 upwardly along the surface 25 in which case the upper member 22 is joined to the lower member 21 beneath the insulation layer 17. The upper member 22 is preferably a membrane compatible with the roof membrane 19. Preferably, the upper member 22 is reinforced with a nylon or polyester mesh to give it additional strength. A portion of the upper member 22 overlies the roof structure 10 and is preferably adhesively sealed to the roof membrane 19. The member 22 may also be welded or mechanically affixed to the membrane 19. As shown in FIG. 1, the roof membrane 19 is preferably extended upwardly along the wall 13.

The upper and lower air seal members 22 and 21 are preferably fastened together by crimping the longitudinal edge of the metal member 21 over the juxtaposed longitudinal edge of the upper member 22. For the application shown in FIG. 1, securement fasteners 27 are used to attach the structure to the parapet wall 13. Application of a sealant 28 between the wall and the joined members 21 and 22 effects an air closure of the roof structure 10 about the perimeter thereof abutting the parapet wall 13. A suitable sealant 28 may be uncured butyl rubber applied to the wall 13 as a tape against which the air seal members 21 and 22 are nailed or screwed. The seal created by the sealant 28 and the air seal members 21 and 22 provides a peripheral seal at the parapet wall 13 which is below the dew point. Humid air from the building will not cause condensation at this peripheral seal.

As seen from FIG. 1, the roof structure 10 is independent of the vertical flashing structure 12 which comprises a membrane flashing 35 sealed to the vertical wall face 36 and extending horizontally over and being sealed to a peripheral top portion of the roof membrane 19. The stabilizing influence of the air seal members 21 and 22 at the periphery of the roof structure 10 also stabilizes the flashing structure 12. This is because the air seal members 21 and 22 restrain the roof membrane 19 and insulation layer 17 from horizontal movement which may otherwise be caused, for example, by thermal loads on the structure 10, and the structure 10 is restrained from vertical movement caused, for example, by pressure differentials across the structure 10.

The invention provides an air seal at the perimeter of the horizontal roof structure 10 thus preventing the entry of moisture laden air beneath the roof membrane 19 or the flashing membrane 35. A loose laid mechanically attached membrane 19 or roof structure 10 not having a ballast layer of aggregate 20 is subject to billowing of the membrane 19 from the wind coupled with air leakage from the building itself. This billowing provides a pumping action for air within the building which encourages the ingress of moisture laden air and condensation beneath the membrane 19. Securement of the membrane 19 to the air seal member 22 effectively seals off the membrane 19 from the air within the building. This arrangement holds the roof structure 10 in place and effectively retards billowing of the membrane 19.

For the purpose of constructing a roof, the present invention may be advantageously employed to construct the peripheral portions first comprising the upper and lower air seal members 22 and 21 and the associated insulation layer portion 17. Since the non-roofing trades are only required for the installation of structures at the periphery of the roof, completion of this stage of construction first allows the roofer to quickly install the bulk of the roof structure 10. This procedure gives the roofer greater control over the quality of the construction, and therefore, enables the roofer to be more confident in the integrity of the entire structure. In fact, a roof constructed in accordance with the present invention may be done completely by the roofer alone in many instances. Because the impact of other trades is minimized by making a roof as presently described, responsibility for the performance of the roof will rest with the roofer. Roof failure due to errors in construction made by non-roofing workers is minimized.

Figure 2:
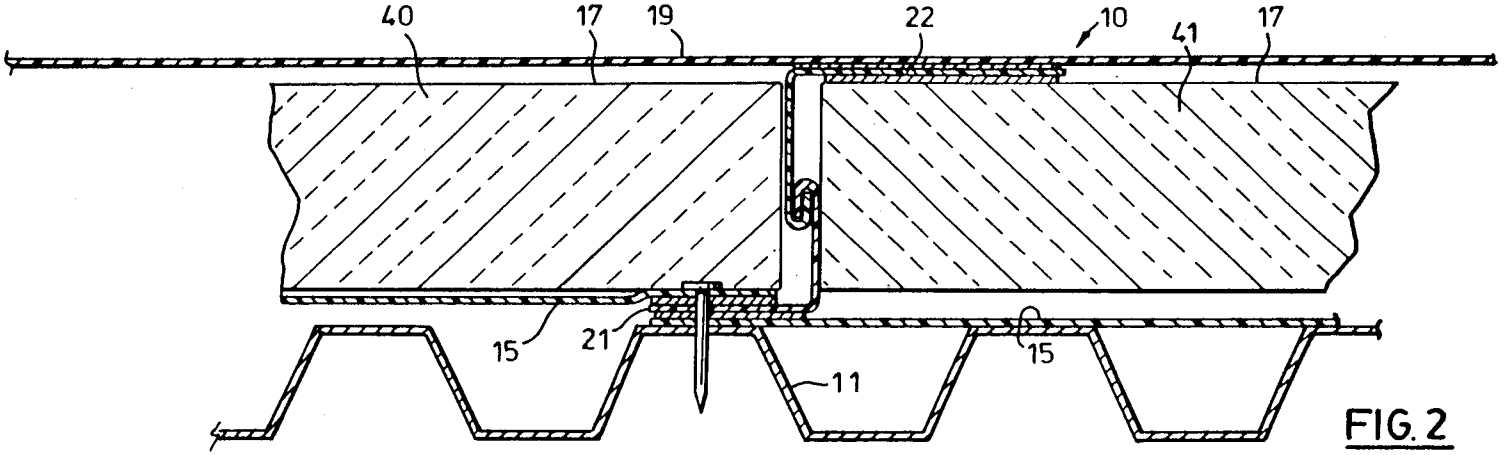
FIG. 2 is a cross sectional view of a water cut off structure for a roof using the seal members of the invention.

As seen in FIG. 2, the air seal members 21 and 22 may be used within the horizontal roof structure 10 to subdivide the roof into a plurality of roof sections.

The use of the seal members 21 and 22 in accordance with this aspect of the invention is as follows. A portion of the lower sheet metal seal member 21 is attached to the deck 11 and is sealed to the vapor barrier 15 associated with a first section 40 of the roof structure 10 in a like manner as described above, and a portion of the upper membrane seal member 22 is provided over the insulation layer 17 of a second section 41 of roof structure 10 adjacent the first section 40 and is sealed to the overlying roof membrane 19. The upper and lower members 22 and 21 are joined as previously described. The resulting structure as shown in FIG. 2 provides a cut off for the migration of water beneath the membrane 19. By dividing the roof into sections using the seal members 21 and 22 as shown in FIG. 2, water leaks in the structure 10 are effectively confined to the section having the damaged membrane 19, thereby greatly simplifying and reducing the cost of repair. By restricting the extent to which water can migrate beneath the structure 10, surface detection of water damage is made much easier. This is because the leak is concentrated in a smaller area of the roof causing the insulation layer 17 to develop areas of water saturation which are detectable at the surface of the roof more quickly than would be the case without the use of the invention as shown in FIG. 2. Additionally, this use of the seal members 21 and 22 to divide the roof structure 10 into sections assists in securing the whole structure 10 against thermal and wind forces.

The division of the roof structure 10 into a plurality of sections using the invention as shown in FIG. 2 provides a mechanical securing of the structure 10 to the deck 11 thereby stabilizing the structure 10 against uplifting forces from the wind and thermal effects acting on the structure 10. Additionally, the use of the seal members 21 and 22 about the periphery of the roof structure 10 as well as within the roof structure 10 minimizes thermal bridging across the roof structure 10 by providing a sealed unitary structure having a minimal reliance on wood blocking or other such structural components.

Figure 3:
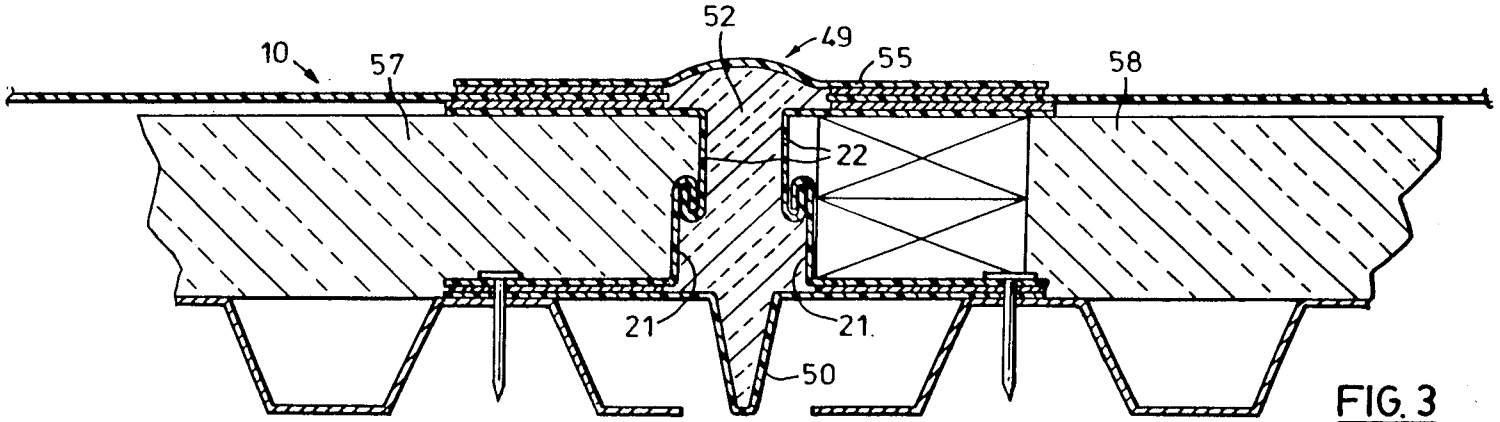
FIG. 3 is a cross sectional view of an expansion joint structure for a roof employing the seal members at the edges of the abutting roof segments.

An application of the seal members 21 and 22 in the construction of an expansion joint 49 for a roof structure 10 is shown in FIG. 3. The expansion joint 49 includes a sheet metal bellows 50 underlying the joint 49 which allows for expansion or contraction about the joint 49 while maintaining the integrity of the roof structure 10. The joint 49 may be filled with filler 52 such as glass fiber or an insulating foam and a membrane flashing 55 is sealed over the joint 49. The use of the members 21 and 22 installed in the same fashion as described above at the periphery of both roof segments 57 and 58 serve to seal both roof segments 57 and 58 from the expansion joint 49. Therefore, failure of the joint 49 will reduce leakage into the roof segments 57 or 58, and will facilitate detection of any such leaks as described above.

As discussed above, an important advantage afforded by the invention is the ability of the roofer to exercise greater control over the construction of the roof. Frequently, the roofer cannot complete the assemby of the roof structure 10 without interruption. During periods when the roof is partially constructed, damage to it can occur from wind and rain. This damage is usually caused by wind getting under the edge of the membrane 19 causing it to tear. Water is then able to penetrate into the portion of the roof structure 10 completed to that stage, causing damage. By employing the seal members 21 and 22 to secure the edge of the membrane 19 at the periphery of the partially finished roof structure 10, the completed portion of the roof is secured from wind or rain damage. This type of arrangement would be similar to that shown in FIG. 2 for the water cut off. The structure may be temporary or may form a permanent part of the roof such as a cut off shown in FIG. 2.

While the foregoing has provided a description of several of the more common applications for the seal members 21 and 22 of the present invention, additional applicatons will be apparent to the skilled person, and such applicatons are intended to fall within the scope of this invention.

I claim:

1. A roof structure for a building, comprising:

a layer of insulation overlying a roof deck and being secured thereto;

a membrane overlying the insulation layer;

a lower seal of rigid construction being fastened to the deck and underlying the layer of insulation abouts it periphery at a lower edge thereof; and an upper seal member having a first portion overlying the layer of insulation about its periphery at an upper edge thereof being above said lower edge, said first portion being sealingly affixed to the membrane, and the upper member having a second portion extending downwardly along an upright side of the insulation and being continuously affixed to the lower seal member about the periphery of the insulation, the upper and lower seal members coacting with the membrane to provide a sealed closure about the periphery of the roof structure and a vapor barrier between the deck and insulation layer, the vapor barrier being continuously sealed to the upper surface of the lower seal member about the periphery of the insulation.

2. A roof structure as claimed in claim 1, wherein the membrane is made of polyvinylchloride or chloro or sulfonylchloro substituted polyethylene, ethylene-propylene terpolymer, or sheet applied modified asphalt.

3. A roof structure as claimed in claim 1, wherein the lower seal member is made of sheet metal.

4. A roof structure as claimed in claim 3, wherein the lower seal member has a continuous portion thereof extending upwardly along an upright side of the insulation layer at said edge.

5. A roof structure as claimed in claim 3, wherein the upper and lower seal members are affixed together by crimping the longitudinal edge of the lower member over the juxtaposed longitudinal edge of the upper member.

6. A roof structure as claimed in claim 1, wherein the upper seal member is made of the same or a compatible material to that of the membrane.

7. A roof structure for a building, comprising:

a layer of insulation overlying a roof deck and being secured thereto;

a membrane overlying the insulation layer, and an air seal structure about the insulation layer at a parapet wall of the building and being continuously adhesively sealed to the wall along its interior perimeter, the air seal structure having a lower seal member of rigid constrution being fastened to the deck and underlying the layer of insulation about its periphery at a lower edge thereof, and an upper seal member having a first portion overlying the insulation layer about its periphery at an upper edge thereof being above said lower edge, said first portion being sealingly affixed to the membrane and the upper member having a second portion extending downwardly along an upright side of the insulation and being continuously affixed to the lower seal member about the periphery of the insulation, the upper and lower seal members coacting with the membrane and the parapet wall to provide a sealed closure about the periphery of the roof structure;

and a vapor barrier between the deck and insulation layer, the vapor barrier being continuously adhesively sealed to the upper surface of the lower seal member about the periphery of the insulation.

8. A roof structure as claimed in claim 7, wherein said air seal structure is adhesively sealed and mechanically fastened to the parapet wall.

9. A roof structure as claimed in claim 1, wherein the membrane is made of polyvinylchloride or chloro or sulfonylchloro substituted polyethylene, ethylene-propylene terpolymer, or sheet applied modified asphalt.

10. A roof structure as claimed in claim 7, wherein the lower seal member is made of sheet metal.

11. A roof structure as claimed in claim 10, wherein the lower seal member has a continuous portion thereof extending upwardly along an upright side of the insulation layer at said edge.

12. A roof structure as claimed in claim 10, wherein the upper and lower seal members are affixed together by crimping the longitudinal edge of the lower member over the juxtaposed longitudinal edge of the upper member.

13. A roof structure as claimed in claim 7, wherein the upper seal member is made of the same or a compatible material to that of the membrane.

14. A roof structure as claimed in claim 1, further comprising:

an air seal structure positioned between first and second sections of the insulation layer, the air seal structure having a lower seal member or rigid construction being adhesively sealed to the vapor barrier being fastened to the deck and underlying the first section of insulation along a lower edge thereof, and an upper seal member having a first portion overlying the second section of insulation along an upper edge thereof, said first portion being sealingly affixed to the membrane and the upper member having a second portion extending downwardly between the first and second insulation sections and being continuously affixed to the lower seal member, the upper and lower seal members coacting with the membrane to provide a sealed closure between the insulation sections.

15. A roof structure as claimed in claim 14, wherein the membrane is made of polyvinylchloride or chloro or sulfonylchloro substituted polyethylene, ethylene-propylene terpolymer, or sheet applied modified asphalt.

16. A roof structure as claimed in claim 14, wherein the lower seal member are made of sheet metal.

17. A roof structure as claimed in claim 16, wherein each lower seal member has a portion thereof extending upwardly along an upright side of the insulation layer at said edge.

18. A roof structure as claimed in claim 16, wherein the upper and lower seal members are affixed together by crimping the longitudinal edge of the lower member over the juxtaposed longitudinal edge of the upper member.

19. A roof structure as claimed in claim 16, wherein each upper seal member is made of the same or a compatible material to that of the membrane.

* * * * *